United States Patent [19]

Antipov et al.

[11] 4,121,670

[45] Oct. 24, 1978

[54] IMPACT WRENCH

[75] Inventors: Georgy Afanasievich Antipov, Moscow; Vitaly Alexandrovich Berezhnoi, Rostov-na-Donu; Mikhail Lvovich Gelfand, Moscow; Boris Grigorievich Goldshtein, Moscow; Leonid Avrumovich Gornik, Moscow; Nikolai Stanislavovich Lavnikov, Rostov-na-Donu; Leonid Nikolaevich Teres, Rostov-na-Donu; Ivan Ivanovich Urazhdin, Rostov-na-Donu; Yakov Isaakovich Tsipenjuk, Solntsevo Moskovskoi oblasti; Petr Stepanovich Yakubovsky, Rostov-na-Donu, all of U.S.S.R.

[73] Assignee: Vsesojuzny Nauchno-Issledova-Telsky I Proektno-Konstruktorsky Institut Mekhanizirovannogo I Ruchnogo Stroitelno-Montazhnogo Instrumenta, Vibratorov I Stroitelno-Otdelochnykh Mashin, U.S.S.R.

[21] Appl. No.: 772,147

[22] Filed: Feb. 25, 1977

[51] Int. Cl.[2] ..... B21J 11/02

[52] U.S. Cl. ..... 173/20; 173/1; 91/35

[58] Field of Search ..... 173/1, 2, 12, 20, 93; 91/35, 36, 37, 38, 39, 40

[56] References Cited

U.S. PATENT DOCUMENTS

| | | | |
|---|---|---|---|
| 3,908,257 | 9/1975 | Briles | 173/2 |
| 3,952,814 | 4/1976 | Gelfand et al. | 173/93 |
| 4,026,369 | 5/1977 | Vliet | 173/12 |

*Primary Examiner*—Robert A. Hafer

*Attorney, Agent, or Firm*—Robert E. Burns; Emmanuel J. Lobato; Bruce L. Adams

[57] ABSTRACT

The invention relates to impact wrenches for tightening threaded joints comprising an impact clutch accommodated in a housing and having a hammer which is axially movable for imparting each blow, and a device for automatically limiting the number of blows to a pre-set number of blows. The device for automatically limiting the number of blows comprises a blow number setter, a movable member directly co-operating with the hammer and axially movable upon each axial displacement of the hammer so as to enable the axial displacement of the hammer until a pre-set number of blows are delivered, and a locking device for locking the movable member against displacement in the position preventing further axial movement of the hammer after the ultimate blow of the pre-set number of blows is delivered. Thus the possibility of imparting blows in excess is eliminated without deenergization of the impact wrench drive, and the construction of the impact wrench is simplified.

2 Claims, 16 Drawing Figures

IMPACT WRENCH

BACKGROUND OF THE INVENTION

The present invention relates to tools used for tightening threaded joints, and more specifically, to impact wrenches for torque tightening by delivering a number of rotary blows to a threaded joint.

Torque tightening of threaded joints may be most accurately controlled by the energy method. With the employment of impact wrenches, this method consists in that a preset number of rotary blows are delivered to the threaded joint, every blow having the same energy.

At present, it is known to use impact wrenches featuring low blow rate for torque tightening (cf. U.S. Pat. No. 3,952,814). In these impact wrenches, the number of blows is counted by the operator to turn off the impact wrench after a pre-set number of blows are delivered, that is after a predetermined amount of energy is transmitted to the threaded joint.

In case the operator counts the number of blows, human errors may occur associated with rapid fatigue of the operator thus resulting in the need in an objective control of tightening of threaded joints.

Known in the art are impact wrenches having devices for automatically limiting the number of blows to a pre-set number of blows (cf. USSR Inventor's Certificate No. 272173, Cl. B 25 *b* 21/02) comprising an electrical blow counter which breaks open the supply circuit of the impact wrench motor after a pre-set number of blows are delivered, and the tightening is thus stopped.

It should be, however, noted that the electrical blow counter complicates the electric circuit of the impact wrench because a control circuit is required in addition to the power circuit of the impact wrench. Disadvantages of this counter are also associated with insufficient reliability and durability of a contact setter which is subjected to impact loads during operation, and with difficulties encountered when different types of drive are used for impact wrenches (e.g. pneumatic or hydraulic drive will require two different supply sources, whereas with the employment of a high-frequency low-voltage drive, a number of auxiliary devices are required due to increased current in the power circuit, to prevent burning of the setter contacts, while the size and weight of the impact wrench should remain within the limits acceptable for hand-held power tools).

A device for automatically limiting the number of blows used in a pneumatic wrench (cf. German Pat. No. 2,119,273 Cl. 87*a*, 13) comprises a mechanical adder. This device includes an inertial mass mounted on the rotor shaft for axial movement and acting on a spring-loaded pusher which causes rotation of the adder shaft by means of an overrunning clutch. The adder shaft is connected, by means of bevel gears, to a longitudinal shaft having a freely mounted toothed wheel which is connectible to the longitudinal shaft by means of a friction clutch engageable under the action of compressed air fed from a starting device of the tool. The toothed wheel of the longitudinal shaft meshes with a setting gear having a pin engaging a leverage system connected to a cut-off valve after the gear is turned through a pre-set angle.

This device may only be used in pneumatic impact wrenches. In addition, it has involved force transmitting connections lowering the reliability of operation of the impact wrench.

In any case, disconnection of the drive of an impact wrench for interruption of delivery of blows to a threaded joint substantially complicates the construction of impact wrench and lowers its reliability.

SUMMARY OF THE INVENTION

The main object of the invention is to provide an impact wrench in which the device for automatically limiting the number of blows is so constructed as to prevent further axial movement of the hammer after a pre-set number of blows are delivered without deenergizing the motor.

Another object of the invention is to provide a device for automatically limiting the number of blows which is independent on the type of the impact wrench drive.

Still another object of the invention is to provide an impact wrench having a simple and reliable construction.

These and other objects are accomplished by that in an impact wrench comprising a housing, a drive, an impact clutch including a hammer which is axially movable for imparting each blow, and a device for automatically limiting the number of blows to a pre-set number of blows, according to the invention, the device for automatically limiting the number of blows comprises a blow number setter, a movable member directly co-operating with the hammer which is displaceable upon every axial displacement of the hammer so as to enable the axial displacement of the hammer until a pre-set number of blows are delivered, and a locking device which is in a force transmitting connection with the movable member and which operates in response to every displacement of the movable member so as to enable the displacement thereof and to lock the movable member in the position in which it prevents further axial displacement of the hammer after the ultimate blow of the pre-set number of blows is delivered.

The invention is further characterized in that the movable member is located opposite to the peripheral surface of the hammer, and the hammer has an annular groove on the peripheral surface to receive the movable member.

The invention is also characterized in that the movable member is elastically urged against the peripheral surface of the hammer.

The provision of a device to maintain the hammer against further movement after the pre-set number of blows are delivered enables the elimination of excessive blows without deenergization of the impact wrench drive, whereby the construction of the impact wrench is simplified and reliability is improved, while one and the same device for automatically limiting the number of blows may be used independent on the type of drive.

It is also noted that the above-mentioned construction of the device for locking the hammer, and the provision of the movable member permanently engaging the hammer make it possible to use the hammer displacement directly as signal for actuation of the device thus considerably improving reliability.

The invention is further characterized in that the locking device comprises a latch member which is in permanent engagement with the movable member and which is displaceable together therewith at right angle to the direction of movement of the hammer, and a counting mechanism which is in a force transmitting connection with the latch member and which is displaceable upon every displacement of the latch member for co-operation with the blow number setter after the ultimate blow of the pre-set number of blows is delivered whereby the displacement of the latch member is prevented and the movable member is locked.

In accordance with one embodiment of the device for automatically limiting the number of blows, the blow number setter comprises a number of radial bores made in a housing along a line extending in parallel with the direction of the hammer movement, and a stop pin installed in one of the radial bores depending on the pre-set number of blows. The counting mechanism comprises a rod urged by spring away from the stop pin and passing freely through a bore of the movable member, the rod having a plurality of equally spaced annular projections and a cylindrical end portion, and a detent urged by a spring against the rod which is mounted in the movable member to extend at right angle to the direction of the rod movement, the detent having one tapered end for engaging the annular projections of the rod, the other end of the detent protruding from the housing, the latch member is located diametrically opposite to the detent in a bore of the movable member and has a projection which is staggered relative to the detent axially along the rod.

In accordance with another embodiment of the device for automatically limiting the number of blows, the counting mechanism comprises a rotatable disc partially received in a recess of the movable member and mounted on a shaft extending at right angle to the direction of the hammer movement, the disc being connected to the housing by means of a torsion spring and having equally spaced teeth-made over a part of its periphery, and a detent urged by a spring against the disc which is mounted in the movable member to extend at right angle to the disc and has one tapered end for engaging the teeth of the disc, the other end protruding from the housing, the blow number setter comprising a plate fixed to the shaft for rotation together therewith and having a projection at the distal end received between the teeth of the disc depending on the pre-set number of blows, and a fixed stop mounted to the disc, and the latch member is located opposite to the detent in a bore of the movable member and has a projection which is staggered relative to the detent in the direction of rotation of the disc.

In accordance with still another embodiment of the device for automatically limiting the number of blows, the blow number setter comprises a plurality of bores made in the housing along a line extending at right angle to the direction of the hammer movement, and a stop pin installed in one of the bores depending on the pre-set number of blows, the counting mechanism comprises a rod extending at right angle to the hammer and urged by a spring thereagainst, the rod having ratchet teeth at the end adjacent to the hammer, the number of the teeth being equal to the number of the bores and the spacing of the teeth being equal to the spacing of the bores, and a collar at the intermediate portion thereof, the rod having two diametrically opposed flats at the portion with the ratchet teeth, one flat terminating in the collar, and the other flat extending over the entire length of the collar, a detent comprising a leaf spring secured to the housing, the distal end of the leaf spring engaging the ratchet teeth of the rod, as well as a sleeve mounted in the housing opposite to the collar of the rod and connected to the housing by means of a torsion spring, the sleeve having a pin received in slots of the housing, the latch member comprises a leaf spring located diametrically opposite to the detent and having one end secured to the movable member and the other distal end engaging the ratchet teeth of the rod.

The sleeve is preferably accommodated in a lateral handle of the impact wrench housing.

Thus, impact wrenches having the device for automatically limiting the number of blows according to the invention enable the transmission of a pre-set amount of energy to a threaded joint, thereby ensuring high quality of a tightening job and improving the reliability of the impact wrench.

BRIEF DESCRIPTION OF THE DRAWINGS

The impact wrenches having devices for automatically limiting the number of blows according to the invention will now be described with reference to the accompanying drawings, in which.

DESCRIPTION OF THE PREFERRED EMBODIMENTS

Figure 5:
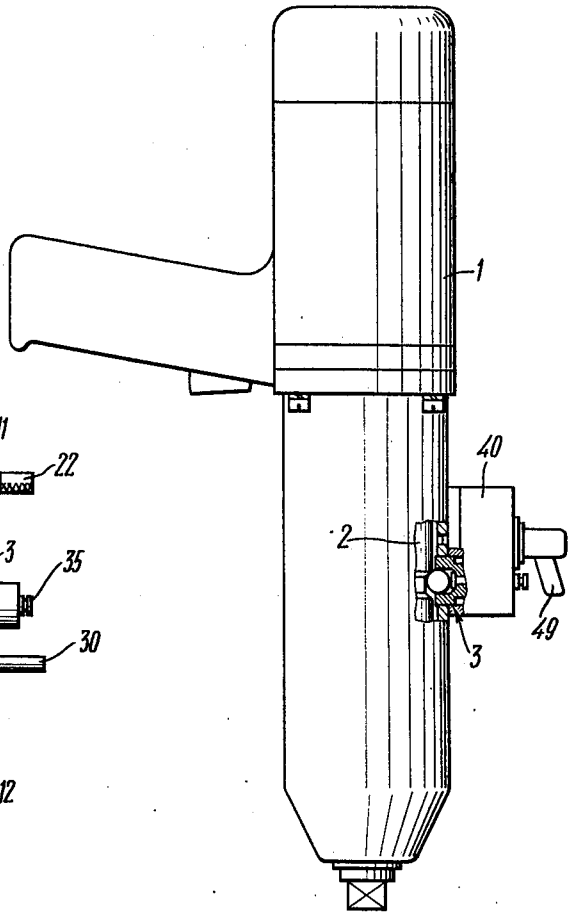
FIG. 5 is a longitudinal side view partially in section of a second embodiment of an impact wrench according to the invention.
Figure 1:
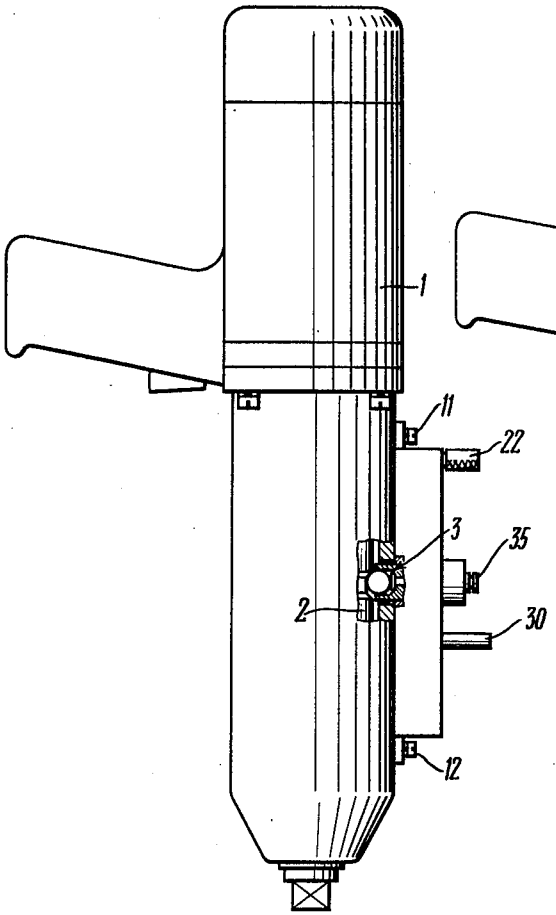
FIG. 1 is a longitudinal side view, partially in section, of an impact wrench according to the invention.

The impact wrenches shown in FIGS. 1 to 11 are of any known type and are not described in detail herebelow, and each impact wrench has a housing 1 (FIGS. 1, 5, 11), a drive of any known type (not shown in the drawings), and an impact clutch including a hammer 2 which is rotated and axially movable for imparting each blow, and a device 3 for automatically limiting the number of blows to a pre-set number of blows.

Figure 12:
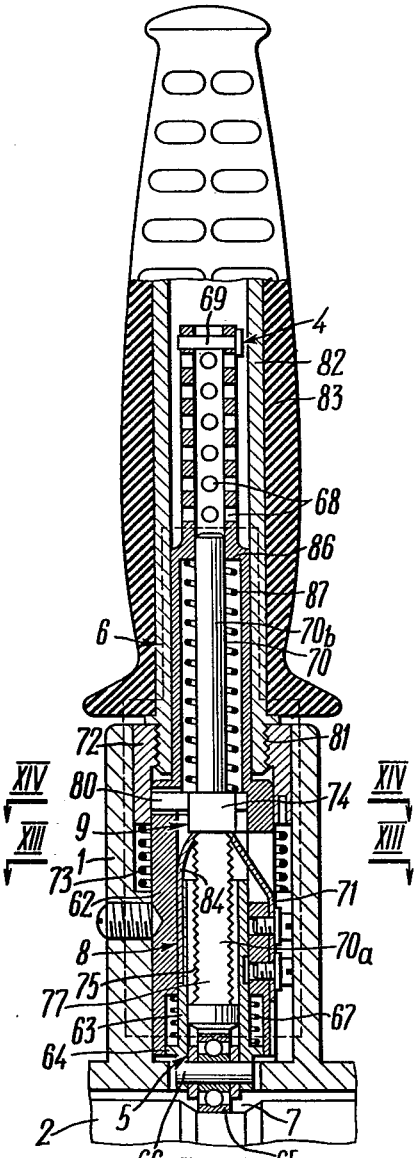
FIG. 12 is an enlarged view, partially in section, of the device for automatically limiting the number of blows of the impact wrench shown in FIG. 11.

The device 3 for automatically limiting the number of blows comprises a blow number setter 4 (FIGS. 2, 6, 12), a movable member 5 permanently engaging the hammer 2 which is movable upon every axial displacement of the hammer 2 so as to enable the free passage thereof until a pre-set number of blows are delivered, and a locking device 6 operating in response to every displacement of the movable member 5 to enable its displacement and to lock the movable member against the displacement in the position in which it prevents further axial displacement of the hammer after the ultimate blow of the pre-set number of blows is delivered.

The locking device 6 is in a force transmitting connection with the movable member 5.

The movable member 5 is located opposite to the peripheral surface of the hammer for movement at right angle to the direction of movement of the hammer 2 and is elastically urged against the peripheral surface of the hammer. The hammer 2 has an annular groove on the peripheral surface thereof to receive the movable member 5 during locking and during axial movement of the hammer 2.

The locking device 6 comprises a latch member 8 and a counting mechanism 9. The latch member 8 permanently engages the movable member 5 and is displaceable together therewith at right angle to the direction of movement of the hammer 2.

The counting mechanism 9 is in a force transmitting connection with the latch member 8 and is displaced upon every displacement of the latch member 8 to co-operate with the blow number setter 4, whereby the latch member 8 is prevented from displacing and the movable member 5 is locked.

Specific embodiments of the blow number setter 4 and locking device 6 may be different as shown in FIGS. 2 to 16.

Figure 2:
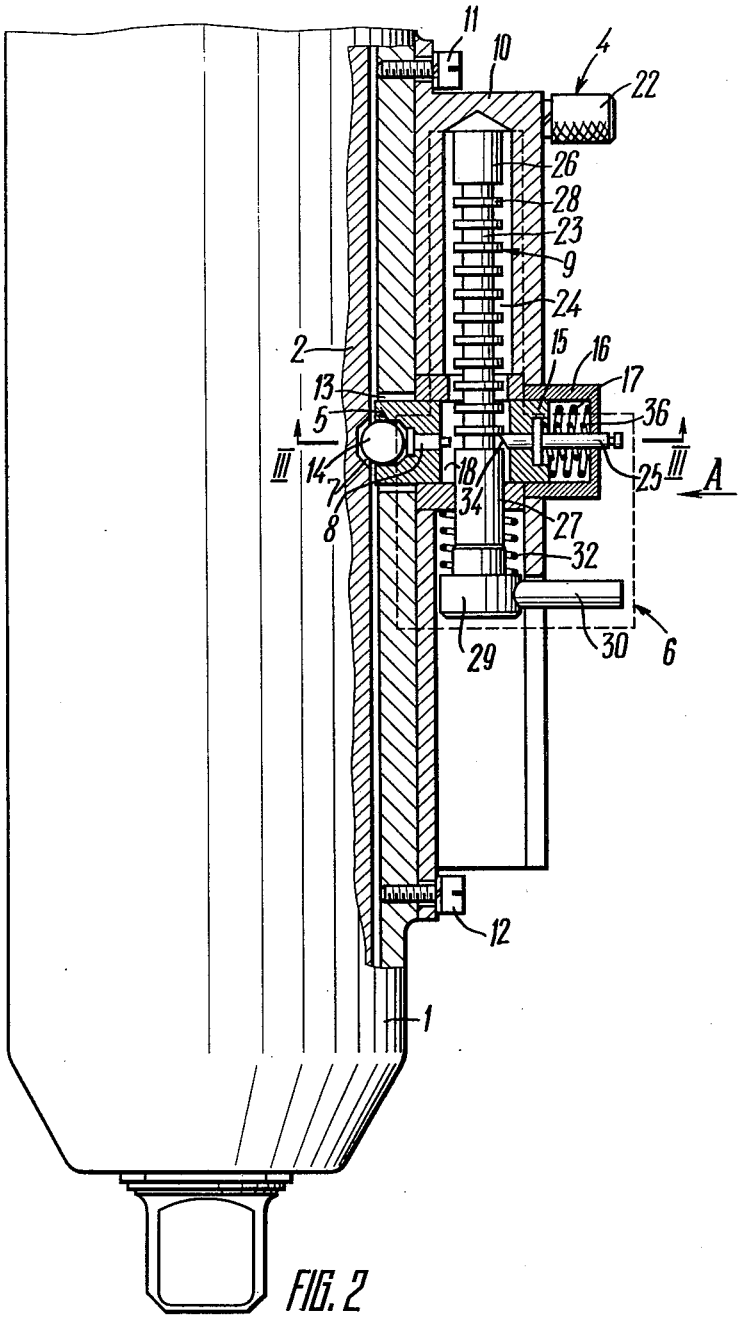
FIG. 2 is a fragmentary enlarged sectional view of the device for automatically limiting the number of blows of the impact wrench shown in FIG. 1.

Thus, in the impact wrench shown in FIG. 2, the device 3 for automatically limiting the number of blows is accommodated in an additional housing 10 rigidly secured to the housing 1 by means of screws 11 and 12, the housing 1 having an opening 13 opposite to the movable member 5.

In this embodiment of the device 3, the movable member 5 comprises a ball 14 received in the annular groove 7 of the hammer which and a slider 15 in contact therewith mounted in a sleeve 16 accommodated in the additional housing 10. A spring 17 disposed between the bottom wall of the sleeve 16 and the slider 15 elastically urges the ball 14, through the slider 15, against the peripheral surface of the hammer 2.

The slider 15 has a bore 18 extending in parallel with the direction of movement of the hammer 2, and two diametrically opposed bores 19 and 20 (FIG. 3) extending at right angle to the bore 18.

Figure 4:
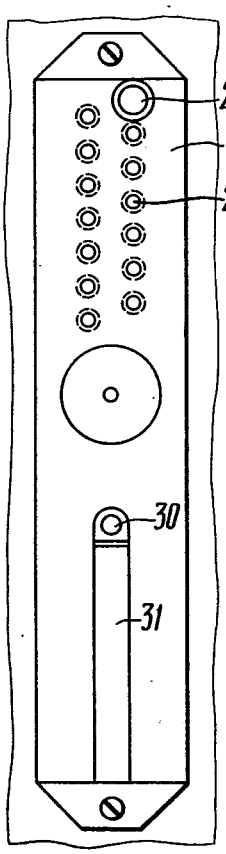
FIG. 4 is a view taken along the arrow A in FIG. 2.

The blow number setter 4 (FIG. 2) comprises a plurality of radial bores 21 (FIG. 4) made in the additional housing 10 along a line extending in parallel with the direction of movement of the hammer 2, in two rows as shown in FIG. 4, and a stop pin 22 installed in one of the bores 21 depending on the pre-set number of blows. The number of the bores 21 (FIG. 4) is equal to the maximum number of blows after delivery of which the hammer will be locked.

The counting mechanism 9 (FIG. 2) comprises a rod 23 received in the inner space 24 of the additional housing 10, and a detent 25 which is urged by a spring against the rod 23 and is located in the bore 20 (FIG. 3) of the slider 15 of the movable member 5 to extend at right angle to the direction of movement of the rod 23.

The rod 23 (FIG. 2) has two cylindrical portions 26 and 27, and a plurality of equally spaced annular projections 28 located between these cylindrical portions.

The cylindrical portion 26 is provided for co-operation with the stop pin 22, and the cylindrical portion 27 has a collar 29 and a handle 30 protruding from the additional housing through a longitudinal slot 31 thereof (FIG. 4) for lifting the rod 23 (FIG. 2) to the upper position in which it bears against the stop pin 22. In the lowermost position, the rod 23 bears against the screw 12.

The rod 23 passes freely through the bore 18 of the slider 15 and is urged by a spring 32 away from the stop pin 22, one end of the spring 32 bearing against the sleeve 16, and the other end, against the collar 29.

The detent 25 (FIG. 3) comprises a rod which has a collar 33 and two flats preventing rotation of the rod upon axial displacement at the intermediate portion thereof. The length of the detent 25 is such that one end 34 of the detent protrudes into the bore 18 and the other end protrudes through the bore in the bottom wall of the sleeve 16 outside and defines a knob 35.

The detent 25 is urged by a spring 36 which bears with the ends thereof against the bottom wall of the sleeve 16 and collar 33.

Figure 3:
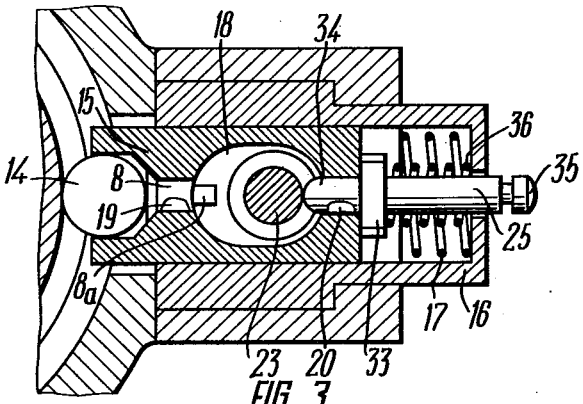
FIG. 3 is an enlarged sectional view taken along section line III—III in FIG. 2.
Figure 13:
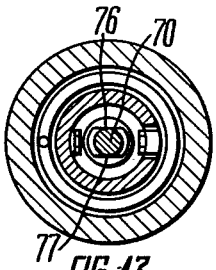
FIG. 13 is a sectional view taken along the line XIII—XIII in FIG. 12.
Figure 14:
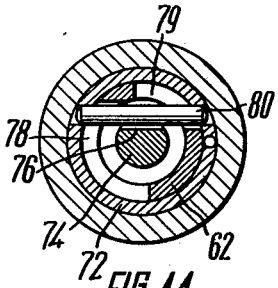
FIG. 14 is a sectional view taken along the line XIV—XIV in FIG. 12.
Figure 15:
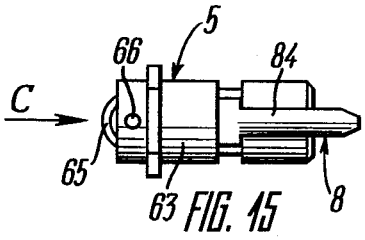
FIG. 15 shows an enlarged view of movable and latch members of the devices of FIG. 12.
Figure 16:
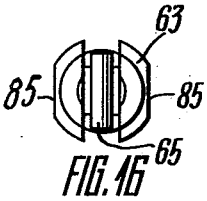
FIG. 16 is an enlarged views taken along the arrow in FIG. 15.

The end 34 of the detent 25 is tapered as shown in FIG. 3, and the rod 23 bears against the end 34 with the annular projections 28 thereof.

The latch member 8 of the locking device 6 comprises an insert mounted in the bore 19 (FIG. 3) of the slider 15 and having a projection **8*a* radially protruding into the bore 18 as shown in FIG. 3. The latch member 8 is located diametrically opposite to the detent 25, and the projection 8*a* thereof is staggered relative to the point of the end 34 of the detent 25 axially along the rod 23 as shown in FIG. 2**.

With this embodiment of the device 3, the hammer is prevented from axially displacing after a pre-set number of blows are delivered in the following manner.

After the stop pin 22 (FIG. 2) is installed in one of the bores 21 corresponding to the number of blows required to achieve a predetermined tightening force in a threaded joint, and after the rod 23 is brought, by means of the handle 30, to the position shown in FIG. 2 (the spring 32 is compressed, and the end of the detent 25 engages one of the annular projections 28), the impact wrench drive is turned on. As a result, the hammer is axially displaced for imparting a blow after a predetermined rotational speed is achieved. After delivery of each blow, the hammer 2 returns back to the initial position shown in FIG. 2.

During the axial displacement of the hammer 2, the ball 14 of the movable member 5 is forced radially out of the annular groove 7 of the hammer. Accordingly, the slider 15 of the movable member is also displaced in the same direction, together with the detent 25 and latch member 8. Thus, the end 34 of the detent 25 disengages from the annular projection 28, and the rod 23 is displaced axially under the action of the spring 32 until the annular projection 28 engages the projection **8*a* of the latch member 8 (earlier, the tapered end 34 of the detent 25** was in engagement with this annular projection).

After the blow is delivered, the hammer 2 returns back into the initial position. At the same time, the movable member 5 and the latch member 8, which are acted upon by the spring 17, and the detent 25, which is acted upon by the spring 36, are also moved radially back into the initial position, and the ball 14 of the movable member enters the annular groove 7 of the hammer. After the latch member 8 disengages from the annular projection 28, the rod 23 is moved axially until the next annular projection bears against the tapered end 34 of the detent 25.

Therefore, after the delivery of one blow, the rod 23 is displaced at the amount of one spacing of the annular projections or collars 28. At every next movement of the hammer (upon every blow), the rod 23 is consecutively displaced one spacing of the collars. After the ultimate blow is delivered, which is determined by the position of the stop pin 22, the flat cylindrical portion 26 of the rod 23 is positioned against the end 34 of the detent 25 to prevent its further radial movement, hence, the displacement of the movable member 5. As a result, the ball 14 cannot leave the annular groove 7 of the hammer thus obstructing the axial passage of the hammer 2. The hammer 2 cannot be axially displaced for imparting a blow, and the tightening is stopped.

Therefore, after a pre-set number of blows required to obtain a predetermined tightening force are delivered to the threaded joint, the hammer 2 of the impact wrench is automatically locked, and excessive blows are not imparted with the drive still operating.

For tightening the next threaded joint, the drive is put off, then the rod 23 is brought in the position in which it bears against the stop pin 22, and the drive is put on so that the impact wrench again functions as described above.

When it is necessary to deliver a different number of blows, the detent 25 is radially moved by means of the knob 35 to disengage it from the annular projection 28 so that the rod 23 is moved under the action of the spring 32 to the lowermost position, and the stop pin 22 is installed into another bore 21. Then the detent 25 is released to be displaced under the action of the spring 36 to bear against the end face of the cylindrical portion 26. The rod 23 is then lifted by means of the handle 30 to bear against the stop pin 22, and the position of the rod is fixed by the detent 25. The impact wrench can be now used for tightening a threaded joint, and the hammer 2 will be locked after the delivery of a pre-set number of blows corresponding to a new position of the stop pin 22 and to another predetermined tightening force.

In the impact wrench shown in FIGS. 5, 6 the mechanisms of the device 3 for automatically limiting the number of blows are made in the following manner.

The movable member 5 (FIG. 6) comprises a ball 37 received in the annular groove 7 of the hammer which is a slider 38 in permanent contact therewith mounted in a sleeve 39 accommodated in an additional housing 40 which is secured to the housing 1. The ball 37 is elastically urged, through the slider 38, against the peripheral surface of the hammer 2 by a spring 41 (FIG. 7) which is located between the slider 38 and the bottom wall of the sleeve 39.

A recess 42 is made in the slider 38 to extend in parallel with the direction of the hammer movement, and there are provided two diametrically opposed bores 43 and 44 extending at right angle to the recess 42.

The counting mechanism 9 (FIG. 6) comprises a rotatable disc 45 having teeth 46 (FIG. 8) equally spaced along a portion of the periphery thereof and a solid portion 47.

The disc 45 (FIG. 6) is partially received in the recess 42 of the slider 38 and is mounted on a shaft 48 extending at right angle to the direction of movement of the hammer 2.

The number of the teeth 46 of the disc 45 is equal to the maximum number of blows after the delivery of which the hammer is locked.

Figure 6:
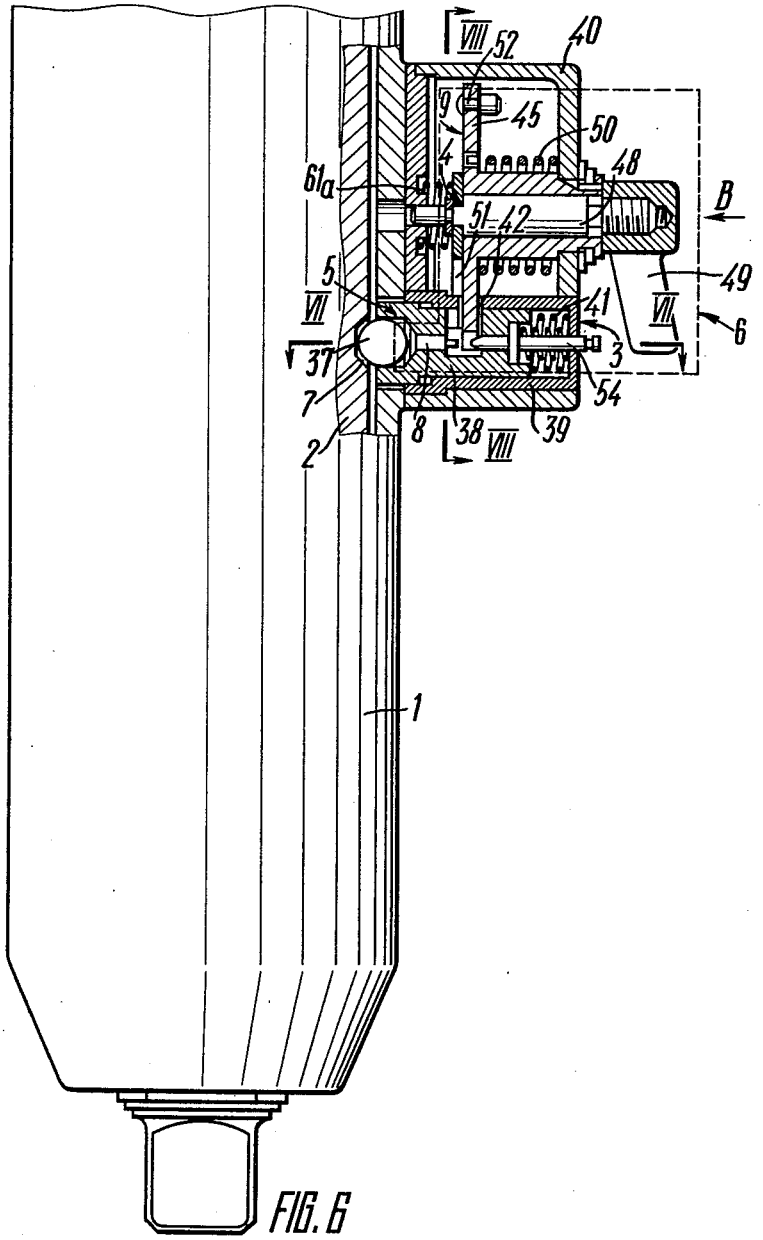
FIG. 6 is a fragmentary enlarged sectional view of the device for automatically limiting the number of blows of the impact wrench shown in FIG. 5.
Figure 7:
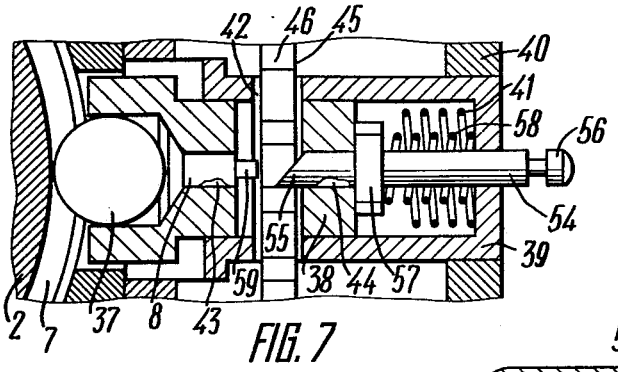
FIG. 7 is an enlarged sectional view taken along the line VII—VII in FIG. 6.

The shaft 48 has one end thereof which is mounted in the additional housing 40 as shown in FIG. 6, and the other end of the shaft protrudes therefrom, and a knob 49 is fixed to the other end of the shaft. A torsion spring 50 mounted on the shaft 48 has one end secured to the disc 45 and the other end, to the additional housing 40.

The blow number setter 4 comprises a plate 51 (FIG. 8) which is fixed with one end thereof to the shaft 48 for rotation together therewith, and a stop 52 fixed to the disc 45 (FIG. 6).

Figure 9:
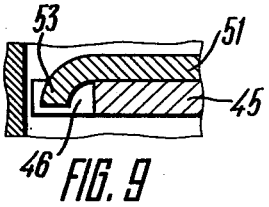
FIG. 9 is a sectional view taken along section line IX—IX in FIG. 8 (turned)
Figure 10:
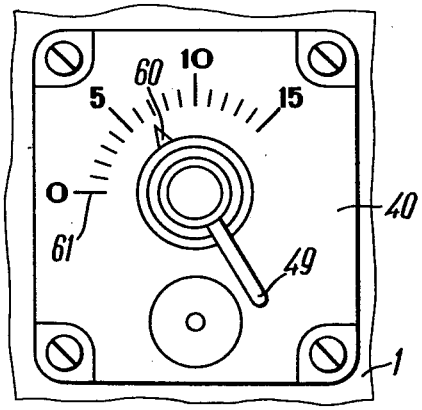
FIG. 10 is a view taken along the arrow B in FIG. 6.

The distal end of the plate 51 (FIG. 9) has a projection 53 which is formed by the bent end of the plate as shown in FIG. 9. The plate 51 is mounted with the projection 53 received between any teeth of the disc 45 depending on the pre-set number of blows after the delivery of which the hammer should be locked.

Apart from the disc 45, the counting mechanism 9 also includes a detent 54 (FIGS. 6 and 7) which comprises a rod mounted in the bore 44 of the slider 38 at right angle to the disc 45 and having a tapered end 55 for engaging the teeth 46 of the disc 45 and an end 56 which protrudes from the sleeve 39 through a hole in the bottom wall thereof to define a knob.

The detent 54 has two flats which prevent it from rotating during the displacement, and a collar 57. The detent 54 is urged by means of a spring 58 having one end which bears against the collar 57 and the other end, against the bottom wall of the sleeve 39.

The latch member 8 comprises a projection which is located in the bore 43 of the slider 38 diametrically opposite to the detent 54 in such a manner that the end 59 thereof is within the recess 42, the end 59 of the projection being staggered relative to the tip of the tapered end 55 of the detent 54 in the direction of rotation of the disc 45.

A pointer 60 is provided on the knob 49 (FIG. 6) and a scale 61 is made on the additional housing 40 so that a pre-set number of blows may be set up.

A spring 61*a* is located between the plate 51 and the housing 41.

With the above-described embodiment of the device 3, the axial displacement of the hammer 2 is prevented after a pre-set number of blows are delivered, in the following manner.

After the projection 53 (FIG. 9) of the plate 51 is placed in one of the indents between the teeth 46 of the disc 45 corresponding to a pre-set number of blows (to a predetermined tightening force of a threaded joint) and after the disc 45 (FIG. 6) and the plate 51 are rotated by means of the knob 49 until the plate 51 bears against the sleeve 39 of the movable member 5, the impact wrench drive is put on, and the hammer is axially displaced to deliver a blow after a predetermined rotational speed is achieved.

During the axial displacement of the hammer 2, the ball 37 of the movable member 5 is forced out of the annular groove 7 of the hammer 2 to displace the slider 38 at right angle to the hammer movement and to compress the springs 41 and 58. Concurrently with the displacement of the slider 38, the detent 54 and the latch member 8 are also moved in the same direction. Thus the tapered end 55 of the detent 54 (FIG. 7) leaves the indent between the teeth 46 of the disc 45 so that the disc 45 and the plate 51 are rotated by the torsion spring 50 until the end 59 of the latch member 8 enters the indent between the teeth 46 (the tapered end 55 of the detent 54 was earlier in the indent between these teeth).

After the blow is delivered, the hammer 2 returns back to the initial position; concurrently, the detent 54, which is acted upon by the spring 58, and the movable member 5, which is acted upon by the spring 41, also return back to the initial position so that the ball 37 enters the annular groove 7 of the hammer. Thus, after the latch 8 leaves, together with the movable member 5, the indent between the teeth 46, the disc 45 is rotated until the next tooth 46 bears against the tapered end 55 of the detent 54.

Therefore, after the delivery of one blow, the disc 45 is rotated through one spacing of the teeth 46. The disc will be rotated consecutively every time through one spacing of the teeth upon every next displacement of the hammer 2 (upon every blow).

Figure 8:
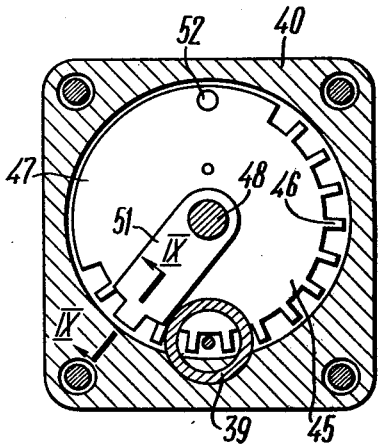
FIG. 8 is a sectional view taken along section line VIII—VIII in FIG. 6.

After the delivery of the ultimate blow which is determined by the position of the plate 51 relative to the disc 45, the solid portion 47 of the disc 45 at which there are no teeth 46, is positioned under the end 59 of the latch member 8 thus preventing its further radial movement, and the stop 52 bears against the sleeve 39 (FIG. 8). The displacement of the movable member 5 is thus prevented. In this position, the ball 37 is received in the annular groove 7 of the hammer to obstruct its passage. As a result, the hammer 2 cannot be axially moved for imparting a next blow, and the tightening is stopped.

Therefore, after a pre-set number of blows required to obtain a predetermined tightening force in a threaded joint are delivered to the threaded joint, the impact clutch of the impact wrench is automatically locked so that blows are not delivered even with the drive on. For tightening a next threaded joint, the drive is put off, the disc 45 is brought in the position in which the plate 51 bears against the peripheral surface of the sleeve 39 by means of the knob 49 (the pointer 60 of the knob 49 in this position is against a figure on the scale 61 corresponding to the number of blows to be delivered), and the drive is put on so that the impact wrench functions as described above.

When it is necessary to set up a different number of blows, the detent 54 is axially displaced by the protruding end 56 thereof to disengage the detent 54 from the tooth 46 of the disc 45. The disc 45 is rotated by the spring 50, and the stop 52 bears against the sleeve 39. Then the knob 49 is unscrewed, the projection 53 of the plate 51 is withdrawn from the indent between the teeth 46 by pressing on the shaft 48 and placed in a new position after rotating the shaft 48 respectively. Then the knob 49 is screwed on the shaft 48 to fix the projection 53 of the plate 51 in the respective indent. The detent 54 is released to be displaced by the spring 58, and the tapered end 55 of the detent enters the indent between the teeth 46 of the disc 45. After the disc 45 is rotated so that the plate 51 bears against the peripheral surface of the sleeve 39, the impact wrench can be used for tightening threaded fasteners, and the automatic locking of the hammer 2 will be effected after the delivery of a pre-set number of blows corresponding to a new position of the plate 51 and to a different predetermined tightening force of threaded joint.

Figure 11:
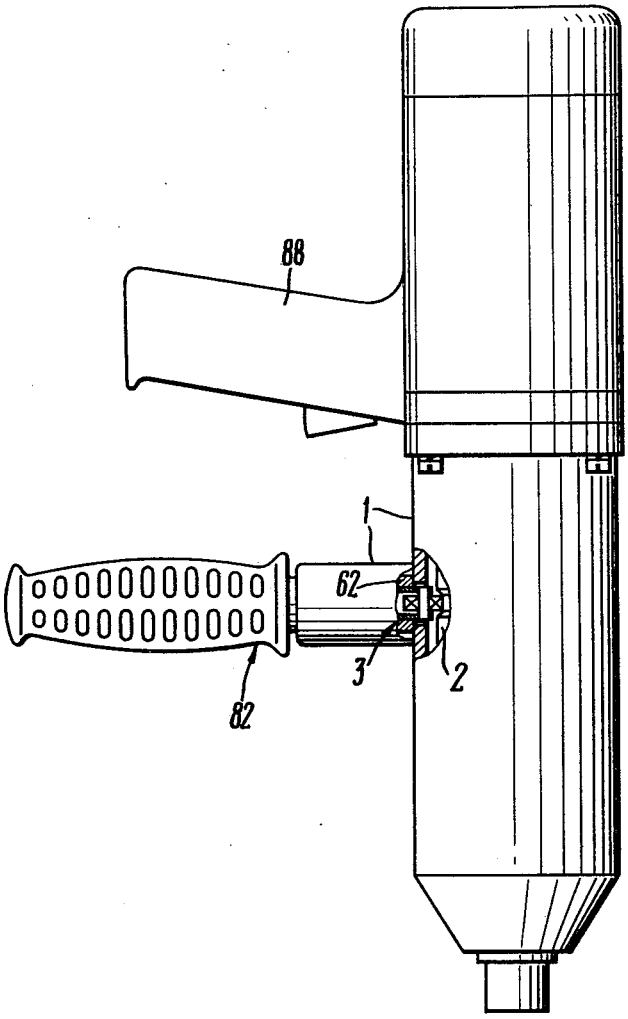
FIG. 11 is a longitudinal side view, partially in section, of a third embodiment of the impact wrench according to the invention.

In the impact wrench shown in FIG. 11, the device 3 for automatically limiting the number of blows is accommodated in an additional housing 62 secured to the housing 1, and the mechanisms of the device are made in the following manner.

The movable member 5 (FIG. 12) comprises a slider 65 having an externally located collar 64 and a ball bearing 65 mounted on an axle 66 and received in the annular groove 7 of the hammer 2, the slider and bearing being accommodated in the additional housing 62 to extend at a right angle to the direction of movement of the hammer 2. The movable member 5 is elastically urged against the hammer 2 by means of a spring 67 having its ends bearing against the collar 64 of the slider 63 and a shoulder of the housing 62.

The blow number setter 4 comprises a plurality of equally spaced bores 68 made in the housing 62 along a line extending at right angle to the direction of movement of the hammer 2, the number of bores being equal to the maximum number of blows, and a stop pin 69 which is installed in one of the bores 68 depending on the pre-set number of blows.

The counting mechanism 9 comprises a rod 70 extending at right angle to the hammer 2 and urged by a spring towards the hammer, a detent 71 comprising a leaf spring secured to the housing 62, and a rotatable sleeve 72 which is connected to the housing 1 by means of a torsion spring 73.

The rod 70 is provided with a collar 74 at the intermediate portion thereof, the end **70*a* of the rod which extends from the collar towards the hammer being provided with ratchet teeth 75, the number of the teeth being equal to the number of the bores 68. The spacing of the ratchet teeth 75 is equal to the spacing of the bores 68**.

The rod 70 is provided with two flats 76 and 77 of different length (FIG. 13) at the portion with the ratchet teeth 75. The flat 77 is made at the end **70*a* of the rod 70 and terminates in the collar 74, and the flat 76 (FIG. 14) extends over the entire length of the end 70*a* of the rod and over the collar 74**.

An end **70*b* (FIG. 12) of the rod 70 which is located behind the collar 74 is adapted to co-operate with the stop pin 69**.

The detent 71 is secured with one end thereof to the housing 62, and the distal end of the detent engages the ratchet teeth 75 of the rod 70.

The rotatable sleeve 72 is mounted outside the housing 69 and is located between the housing 62 and the housing 1 of the impact wrench opposite to the collar 74 of the rod 70.

The housing 62 has slots 78, 79 (FIG. 14) extending over a part of the peripheral surface of the housing 62 and located opposite to the collar 74 of the rod 70. A pin 80 received in the slots 78 and 79 is fixed to the sleeve 72 to extend along a chord of the sleeve and to engage the flat 76 of the collar 74 for rotation of the rod 70 by turning the sleeve 72.

The sleeve 72 has an internal thread 81 (FIG. 12) in which a lateral handle 82 of the impact wrench having a rubber lining 83 is screwed.

The latch member 8 (FIGS. 12 and 15) comprises a leaf spring 84 which is located diametrically opposite to the detent 71. One end of the leaf spring 84 is secured to the slider 63 and the other end engages the teeth 75 of the rod 70.

The slider 63 has flats 85 (FIG. 16) engaging a recess of the housing 1 (not shown) to prevent rotation of the slider.

A return spring 87 is located between the collar 74 of the rod 70 (FIG. 12) and a shoulder 86 of the housing 62.

With the above-described embodiment of the device 3 (FIG. 12) the hammer 2 is prevented from axially displacing after a pre-set number of blows are delivered, in the following manner.

Prior to the beginning of operation, the lateral handle 82 is unscrewed, and the stop pin 69 is installed in the bore 68 which corresponds to a number of blows after the delivery of which the hammer should be automatically locked. After the handle 82 is back in place, the operator sets the impact wrench at the threaded joint by holding it at a handle 88 (FIG. 11) and at the lateral handle 82. All parts of the impact wrench are initially in the position shown in FIG. 12.

After the impact wrench is put on, the hammer 2 is axially displaced in the housing 1. During this displacement of the hammer 2, the ball bearing 65 is forced out of the annular groove 7 of the hammer and, by acting on the slider 63, causes the displacement of the latch member 8 (leaf spring 84) to compress the spring 67. As a result, the rod 70 of the counting mechanism 9 is displaced at one tooth 75 to compress the return spring 87. During the return stroke of the hammer 2, the slider 63 is displaced by the spring 67, and the ball bearing 65 re-enters the groove 7 of the hammer, and the latch member 8 returns back to the initial position (engages the tooth 75 of the rod 70) under the action of the spring 67, while the detent 71 holds the rod 70 from moving backwards. Then the device 3 functions as described above until the end face of the rod 70 will bear against the pin 69 installed in one of the bores 68.

In this position, the slider 63 cannot be moved due to the engagement of the latch member 8 with the fixed rod 70 so that the ball bearing 65 cannot leave the annular groove 7 of the hammer thus obstructing the axial passage of the hammer thereby eliminating the possibility of delivery of further blows by the hammer.

Then the operator puts the impact wrench drive off, and during the transfer of the impact wrench to the next threaded joint, turns the lateral handle 82. The sleeve 72 is thus rotated to overcome the resistance of the torsion spring 73 so that the pin 80 acts on the flat 76 of the rod 70 to rotate the rod and to disengage it from the latch member 8 and detent 71. As a result, the rod 70 is urged by the return spring 87 towards the hammer 2.

Then the operator releases the handle 82, and the sleeve 72 returns back into the initial position under the action of the torsion spring 73 to bring the rod 70 into the position in which its teeth 75 are located opposite to the detent 71 and latch member 8.

The impact wrench is ready for operation.

The arrangement of the device according to the invention in the lateral handle 82 enables the reduction of size of the impact wrench.

What is claimed is:

1. A hand-held impact wrench comprising: a housing; an elongated rotatable hammer driven axially reciprocably in said housing for effecting axial displacement for imparting blows; a settable device on said housing settable to limit the number of axial displacements of said hammer thereby to limit the number of impact blows to a pre-set number; a latch means cooperative with said hammer and displaced to an unlatching position in response to each axial movement of said hammer and operable automatically to a latching position for mounting said hammer in an initial position for travel of the hammer in an impact direction for imparting a pre-set number of impact blows upon restoration of the hammer to said initial position after each impact; said settable device having means manually settable to determine a pre-set number of impacts having counting means cooperative with said hammer mechanically detecting and counting axial displacements of said hammer and having mechanical means effective to lock the hammer upon the number count of detections corresponding with said pre-set number.

2. A hand-held impact wrench according to claim 1, in which said hammer has a circumferential groove, said latch member having a member releasably engageable in said groove for unlatching said latching means when the hammer moves in said impact direction.

* * * * *